US008725034B2

(12) United States Patent
Takigawa

(10) Patent No.: US 8,725,034 B2
(45) Date of Patent: May 13, 2014

(54) IMAGE FORMING APPARATUS INCLUDING PROCESS CARTRIDGE AND DRIVE UNIT WITH BRACKET AND BRACKET BEARING

(75) Inventor: Junya Takigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 171 days.

(21) Appl. No.: 13/314,811

(22) Filed: Dec. 8, 2011

(65) Prior Publication Data

US 2012/0177398 A1 Jul. 12, 2012

(30) Foreign Application Priority Data

Jan. 11, 2011 (JP) ..... 2011-003004

(51) Int. Cl.
*G03G 21/16* (2006.01)
*G03G 15/00* (2006.01)
*G03G 21/18* (2006.01)

(52) U.S. Cl.
CPC ..... *G03G 21/1857* (2013.01); *G03G 21/186* (2013.01); *G03G 21/1864* (2013.01)
USPC ..... 399/111; 399/167

(58) Field of Classification Search
CPC ..... G03G 21/1857; G03G 21/186; G03G 21/1864
USPC ..... 399/111, 167
See application file for complete search history.

(56) References Cited

U.S. PATENT DOCUMENTS

2001/0021320 A1* 9/2001 Murayama et al. ..... 399/117
2005/0281586 A1* 12/2005 Ohashi et al. ..... 399/167
2007/0189805 A1* 8/2007 Takigawa ..... 399/111
2007/0196129 A1* 8/2007 Takigawa et al. ..... 399/167

FOREIGN PATENT DOCUMENTS

JP 2007286575 A 11/2007
JP 2009025704 A 2/2009

OTHER PUBLICATIONS

Abstract of JP 2007-286575 published Nov. 1, 2007.
Abstract of JP 2009-025704 published Feb. 5, 2009.

* cited by examiner

*Primary Examiner* — David Gray
*Assistant Examiner* — Tyler Hardman
(74) *Attorney, Agent, or Firm* — Harness, Dickey & Pierce, P.L.C.

(57) ABSTRACT

An image forming apparatus including a process cartridge having a developing device and detachably installable in the image forming apparatus, and a drive unit to rotatively drive the developing device. The drive unit includes a drive force generator to generate a drive force to rotatively drive the developing device, a drive substrate to support the drive force generator, a drive shaft to transmit the drive force to the developing device, a bracket having a cylindrical bearing seating, a bracket bearing provided inside the bearing seating to support the drive shaft in a thrust direction, and an elastic member provided between the bearing seating and the bracket bearing to allow movement of the drive shaft in a radial direction, and a substrate bearing provided to the drive substrate to support the drive shaft in both the radial and thrust directions.

7 Claims, 8 Drawing Sheets

IMAGE FORMING APPARATUS INCLUDING PROCESS CARTRIDGE AND DRIVE UNIT WITH BRACKET AND BRACKET BEARING

CROSS-REFERENCE TO RELATED APPLICATIONS

The present patent application is based on and claims priority pursuant to 35 U.S.C. §119 from Japanese Patent Application No. 2011-003004, filed on Jan. 11, 2011 in the Japan Patent Office, which is incorporated by reference herein in its entirety.

BACKGROUND OF THE INVENTION

1. Field of the Invention

Exemplary aspects of the present invention generally relate to an image forming apparatus using a process cartridge, and more particularly to an image forming apparatus using a process cartridge capable of accurately and easily coupling a drive shaft and a developing roller without preventing easy installation of the process cartridge in the image forming apparatus.

2. Description of the Background Art

Related-art image forming apparatuses, such as copiers, printers, facsimile machines, and multifunction devices having two or more of copying, printing, and facsimile capabilities typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

In such image forming apparatuses, the developing device and the photoconductor are often formed together as a single integrated unit to construct a process cartridge detachably installable in the image forming apparatuses.

However, even with such a process cartridge, a drive source for the photoconductor and the developing device both installed in the process cartridge is provided to a main body of the image forming apparatus. Therefore, it is important to accurately install the process cartridge in the image forming apparatus in order to prevent uneven image density or banding in resultant images stemming from defective coupling.

There is known a mechanism that accurately couples a drive shaft of a drive source provided to a main body of an image forming apparatus to a driven shaft provided to a process cartridge.

In one example of an image forming apparatus incorporating such a mechanism, a drive shaft provided to a main body of an image forming apparatus is supported by first and second bearings. The second bearing functions as a tentative holding member having a degree of freedom in a radial direction to absorb displacement between the drive shaft and a driven shaft of the developing device provided to the process cartridge. Although generally successful for its intended purpose, with such a configuration there is a risk that a coupling that couples the drive shaft and the driven shaft may slip, causing uneven image density or banding in resultant images.

In another approach, in addition to provide the second bearing as the tentative holding member as described above, a constant-velocity joint is used as the coupling that couples the drive shaft and the driven shaft. However, use of the tentative holding member and the constant-velocity joint, although successful for its intended purpose, increases production costs and complicates assembly.

SUMMARY

In view of the foregoing, illustrative embodiments of the present invention provide a novel image forming apparatus using a process cartridge capable of accurately and easily coupling a drive shaft and a developing roller serving as a driven shaft to prevent uneven image density and banding in resultant images.

In one illustrative embodiment, an image forming apparatus includes a process cartridge having a developing device and detachably installable in the image forming apparatus, and a drive unit provided opposite the process cartridge with a lateral plate of the image forming apparatus interposed therebetween to rotatively drive the developing device. The drive unit includes a drive force generator to generate a drive force to rotatively drive the developing device, a drive substrate to support the drive force generator, a drive shaft to transmit the drive force generated by the drive force generator to the developing device, a bracket provided between the lateral plate and the drive unit and having a cylindrical bearing seating having a center through which the drive shaft passes, a bracket bearing provided inside the bearing seating to support the drive shaft in a thrust direction, and an elastic member provided between the bearing seating and the bracket bearing to allow movement of the drive shaft in a radial direction, and a substrate bearing provided to the drive substrate to support the drive shaft in both the radial and thrust directions.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
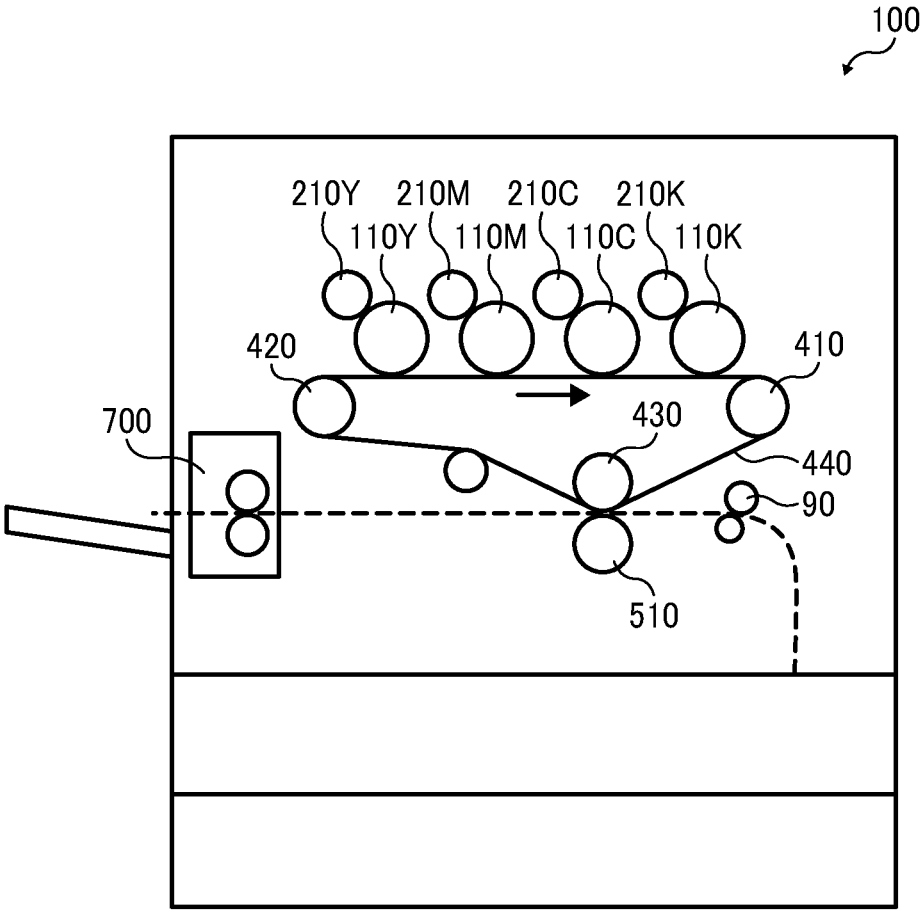
FIG. 1 is a schematic view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of a tandem type full-color image forming apparatus 100 employing an intermediate transfer system according to illustrative embodiments are described in detail below.

Figure 2:
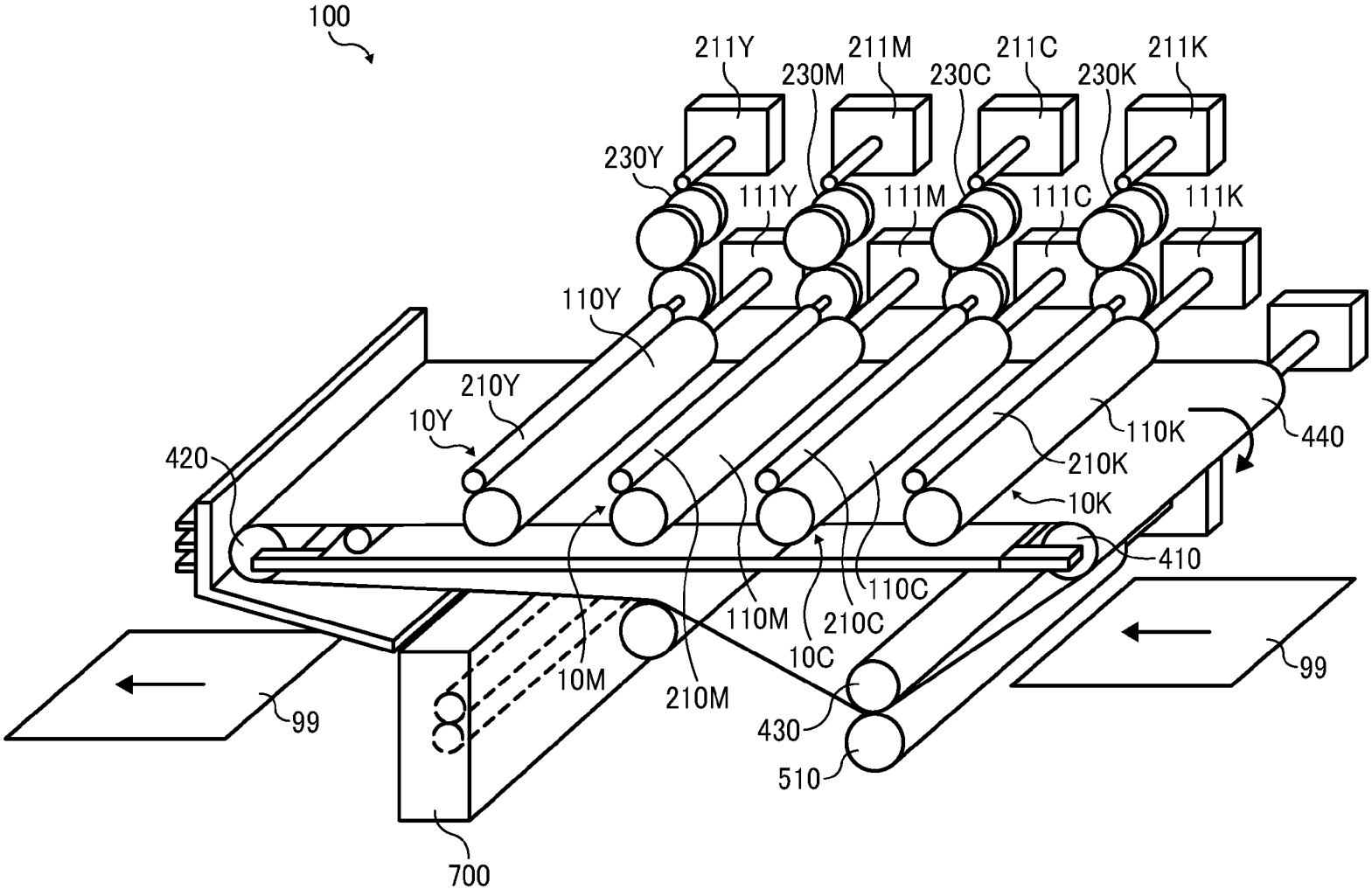
FIG. 2 is a perspective schematic view illustrating an example of a configuration of main components of the image forming apparatus illustrated in FIG. 1.

FIG. 1 is a schematic view illustrating an example of a configuration of the image forming apparatus 100. FIG. 2 is a perspective view illustrating an example of a configuration of main components of the image forming apparatus 100.

The image forming apparatus 100 includes a first roller 410, a second roller 420, a third roller 430 disposed between and below the first and second rollers 410 and 420, and an intermediate transfer belt 440 wound around the first, second, and third rollers 410, 420, and 430. A part of the intermediate transfer belt 440 extending between the first and second rollers 410 and 420 functions as an image formation surface, and four photoconductors 110Y, 110M, 110C, and 110K (hereinafter collectively referred to as photoconductors 110) are provided, in that order from upstream to downstream in a direction of rotation of the intermediate transfer belt 440, above the image formation surface of the intermediate transfer belt 440. The four photoconductors 110 are each rotatively driven by four photoconductor drive motors 111Y, 111M, 111C, and 111K (hereinafter collectively referred to as photoconductor drive motors 111), respectively.

Four developing devices 210Y, 210M, 210C, and 210K (hereinafter collectively referred to as developing devices 210) are provided to contact the respective photoconductors 110. The developing devices 210 are rotatively driven by developing drive motors 211Y, 211M, 211C, and 211K each serving as a drive force generator (hereinafter collectively referred to as developing drive motors 211) via respective drive units 230 described in detail later with reference to FIGS. 4 and 5.

A secondary transfer roller 510 is provided opposite the third roller 430 with the intermediate transfer belt 440 interposed therebetween. Latent images written on surfaces of the photoconductors 110 by a writing unit, not shown, are developed with toner by the developing devices 210 to form toner images of a specific color, that is, yellow (Y), magenta (M), cyan (C), or black (K), on the surfaces of the photoconductors 110, respectively. The toner images thus formed are primarily transferred onto the intermediate transfer belt 440 from the surfaces of the photoconductors 110. Accordingly, the toner images are sequentially transferred onto the intermediate transfer belt 440 and superimposed one atop the other to form a single full-color toner image on the intermediate transfer belt 440.

The full-color toner image is conveyed to the secondary transfer roller 510 as the intermediate transfer belt 440 rotates to be secondarily transferred onto a sheet 99 conveyed to the secondary transfer roller 510 by a transfer timing roller 90. The sheet 99 having the transferred full-color toner image thereon is then conveyed to a fixing device 700 so that the toner image is fixed onto the sheet 99. The sheet 99 having the fixed toner image thereon is discharged from the image forming apparatus 100. Each of the photoconductors 110 and each of the developing devices 210 together construct a process cartridge 10Y, 10M, 10C, or 10K (hereinafter collectively referred to as process cartridges 10) as a single integrated unit detachably installable in the image forming apparatus 100.

The photoconductor drive motors 111, the developing drive motors 211, and the drive units 230 are all installed in a main body of the image forming apparatus 100. Therefore, a mechanism that transmits a drive force from the photoconductor drive motors 111 or the developing drive motors 211 to the photoconductors 110 or the developing devices 210 when the process cartridges 10 are installed in the image forming apparatus 100 is needed.

In illustrative embodiments, a motor shaft of each of the photoconductor drive motors 111 is inserted into a central axis of each of the photoconductors 110 to construct the mechanism that transmits the drive force from the photoconductor drive motors 111 to the photoconductors 110. In addition, the drive force of each of the developing drive motors 211 is transmitted via a corresponding transmission mechanism 213 to a drive shaft 581 of each of the drive units 230, which is joined to a driven shaft 221 of a developing roller 220 provided to each of the developing devices 210 by couplings or gears, to construct the mechanism that transmits the drive force from the developing drive motors 211 to the developing devices 210.

A description is now given of a first illustrative embodiment in which couplings are used in the mechanism that transmit the drive force from the developing drive motors 211 to the developing devices 210.

It is to be noted that each of the four process cartridges 10 detachably installable in the image forming apparatus 100 has the same basic configuration, differing only in the color of toner used. Therefore, only one of the process cartridges 10 is hereinafter shown as a representative example, and the suffixes Y, M, C, and K each representing the color of toner, that is, yellow (Y), magenta (M), cyan (C), and black (K), are omitted from the reference numerals when there is no need to specify the color of toner.

Figure 3A:
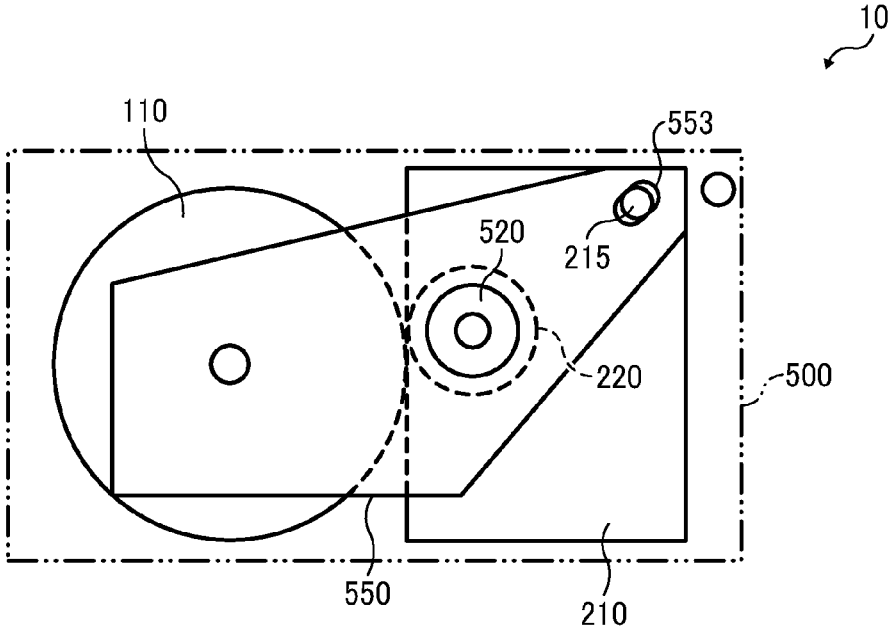
FIG. 3A is a side view illustrating an example of a configuration of a process cartridge detachably installable in an image forming apparatus according to a first illustrative embodiment.
Figure 3B:
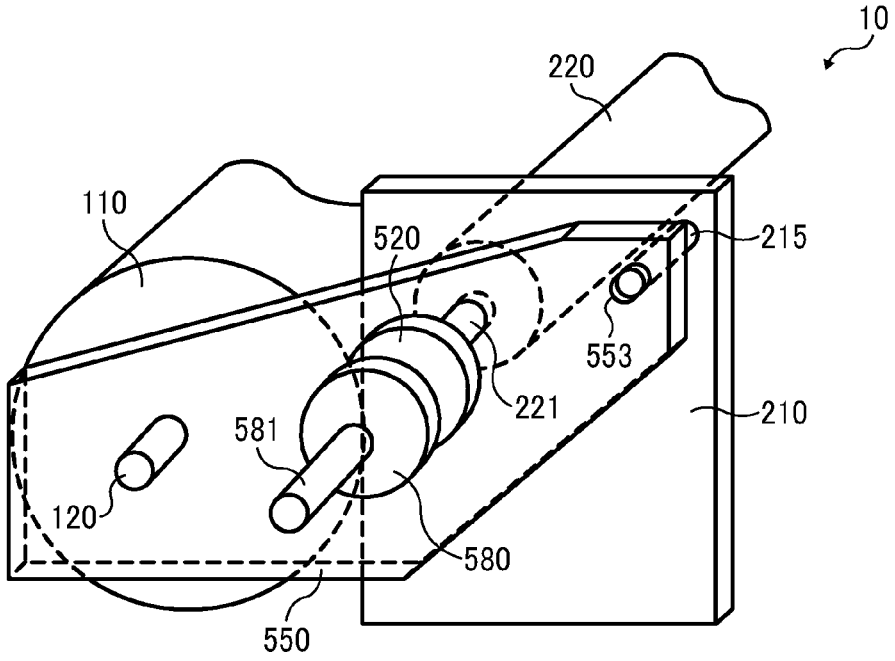
FIG. 3B is a perspective view illustrating the configuration of the process cartridge illustrated in FIG. 3A.

FIG. 3A is a side view illustrating an example of a configuration of the process cartridge 10 detachably installable in the image forming apparatus 100 according to the first illustrative embodiment, and FIG. 3B is a perspective view illustrating the configuration of the process cartridge 10 illustrated in FIG. 3A. It is to be noted that, for ease of illustration, a casing 500 of the process cartridge 10 is omitted in FIG. 3B.

An irregular hexagonal face plate 550 supports a drum shaft 120 of the photoconductor 110 and the driven shaft 221 of the developing roller 220 provided to the developing device 210. A sub-reference pin 215 provided at an upper right corner of the developing device 210 is inserted into a sub-reference hole 553 provided at an upper right corner of the face plate 550.

Thus, the developing device 210 is positioned relative to the face plate 550 using the driven shaft 221 as a main reference and the sub-reference pin 215 as a sub-reference. The driven shaft 221 passes through the face plate 550, and a first coupling 520 is provided to an exposed end of the driven shaft 221.

Figure 4A:
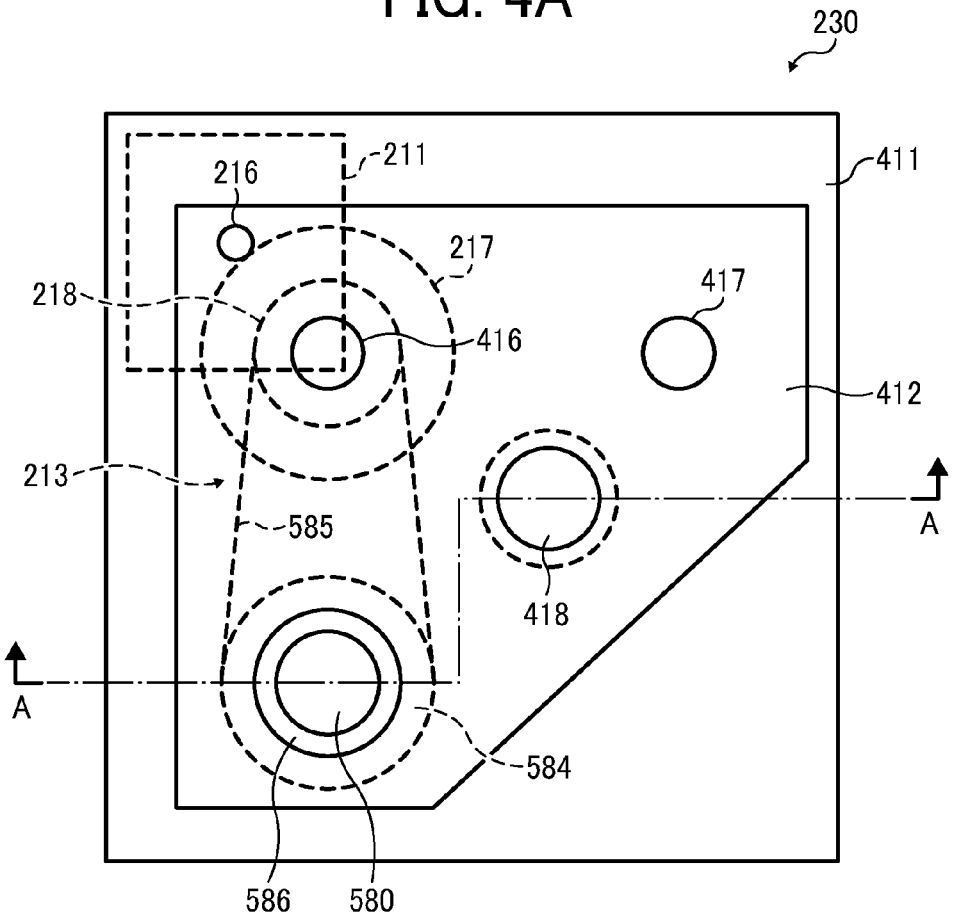
FIG. 4A is a front view illustrating an example of a configuration of a drive unit installed in the image forming apparatus.
Figure 4B:
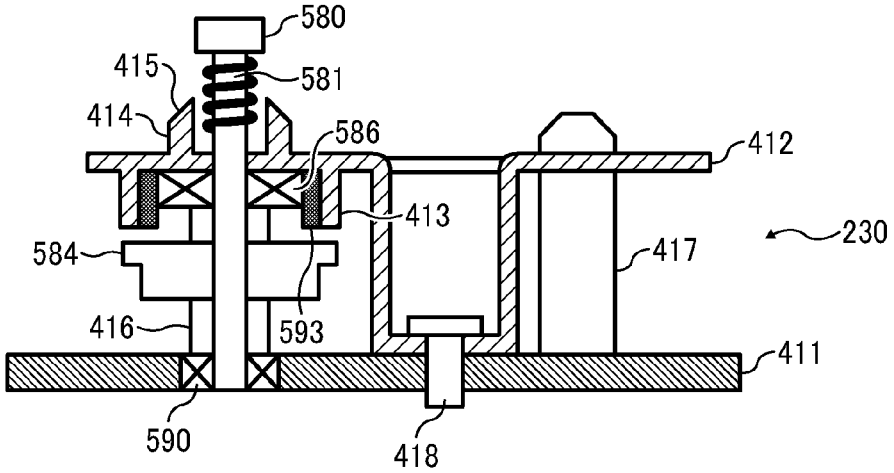
FIG. 4B is a cross-sectional view taken along a line A-A in FIG. 4A.

FIG. 4A is a front view illustrating an example of a configuration of the drive unit 230 installed in the image forming apparatus 100 to drive the developing device 210, and FIG. 4B is a cross-sectional view taken along a line A-A in FIG. 4A. The drive unit 230 is provided between a drive substrate 411 and a bracket 412. The developing drive motor 211 is attached to an outer lateral surface of the drive substrate 411, and a motor shaft of the developing drive motor 211 passes through the drive substrate 411 to be rotatably supported by the drive substrate 411 and the bracket 412.

A main reference pin 416 and a sub-reference pin 417 are inserted into the drive substrate 411. In addition, the drive shaft 581 is inserted into the drive substrate 411 via a substrate bearing 590. The bracket 412 is positioned by the main reference pin 416 and the sub-reference pin 417 and is fixed to the drive substrate 411 at a fastening point 418. It is preferable that the bracket 412 be formed of resin.

Within a space formed between the drive substrate 411 and the bracket 412, a drive gear 216 is provided to the motor shaft of the developing drive motor 211, a reduction gear 217 and a reduction pulley 218 are provided to the main reference pin 416, and a drive pulley 584 is provided to the drive shaft 581.

The drive gear 216 and the reduction gear 217 are disposed to engage each other, and the reduction pulley 218 and the drive pulley 584 are joined together by a timing belt 585. Thus, a rotary drive force of the developing drive motor 211 is transmitted to the drive shaft 581 via the transmission mechanism 213 constructed of the drive gear 216, the reduction gear 217, the reduction pulley 218, the timing belt 585, and the drive pulley 584.

The drive shaft 581 passes through the bracket 412 and is extended outside the bracket 412. A second coupling 580 that couples to the first coupling 520 is provided at a leading edge of the drive shaft 581.

Figure 5:
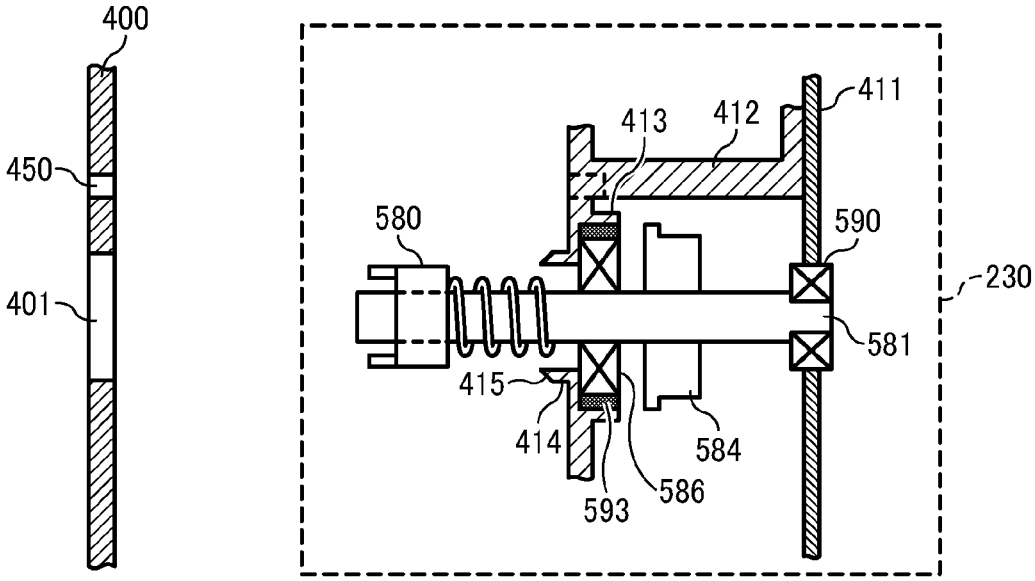
FIG. 5 is an enlarged schematic view illustrating a configuration around a drive shaft provided to the drive unit.

FIG. 5 is an enlarged schematic view illustrating a configuration around the drive shaft 581 provided to the drive unit 230. The drive shaft 581 is rotatably supported by the drive substrate 411 while movement thereof in thrust and radial directions is restricted by the substrate bearing 590 provided to the drive substrate 411. In addition, the drive shaft 581 is supported also by a bracket bearing 586. The bracket bearing 586 is formed together with the bracket 412 as a single integrated member and is inserted into a cylindrical bearing seating 413 protruding toward the drive substrate 411 via an elastic member 593 such as a sponge.

Figure 6:
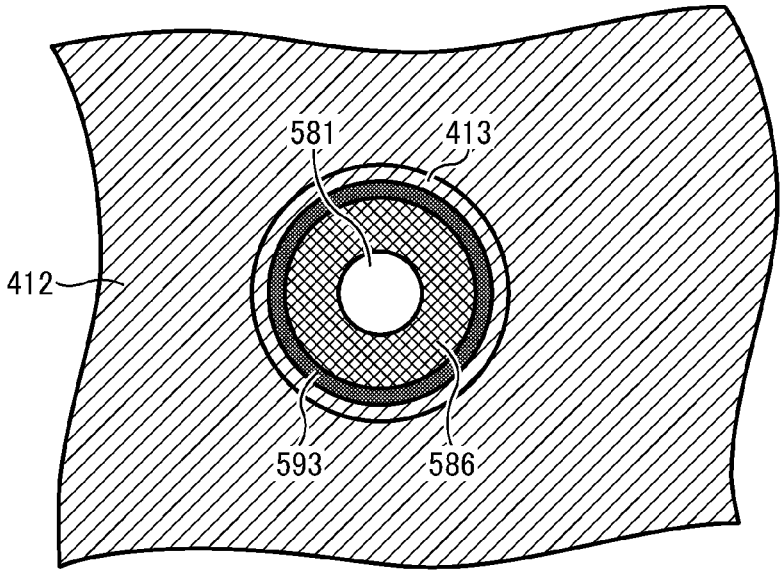
FIG. 6 is a front view illustrating the configuration around the drive shaft.

FIG. 6 is a front view illustrating a configuration around the drive shaft 581 viewed from the drive pulley 584. As illustrated in FIG. 6, the bracket bearing 586 that supports the drive shaft 581 is inserted into the bearing seating 413 with the elastic member 593 interposed therebetween. A cylindrical positioning rib 414 formed together with the bracket 412 as a single integrated member and protruding toward a lateral plate 400 of the image forming apparatus 100 is provided around a hole in the bracket 412 through which the drive shaft 581 passes.

A leading edge 415 of the positioning rib 414 has a tapered shape and functions as a guide member when the drive unit 230 is installed to an attachment hole 401 in the lateral plate 400 of the image forming apparatus 100, thereby facilitating installation of the drive unit 230 in the image forming apparatus 100. Both an outer diameter of the positioning rib 414 and a diameter of the attachment hole 401 are smaller than an outer diameter of the bracket bearing 586 so that a thrust force applied to the bracket bearing 586 can be supported by the lateral plate 400 of the image forming apparatus 100. As a result, damage to the bracket 412 and the elastic member 593 can be prevented.

Figure 7B:
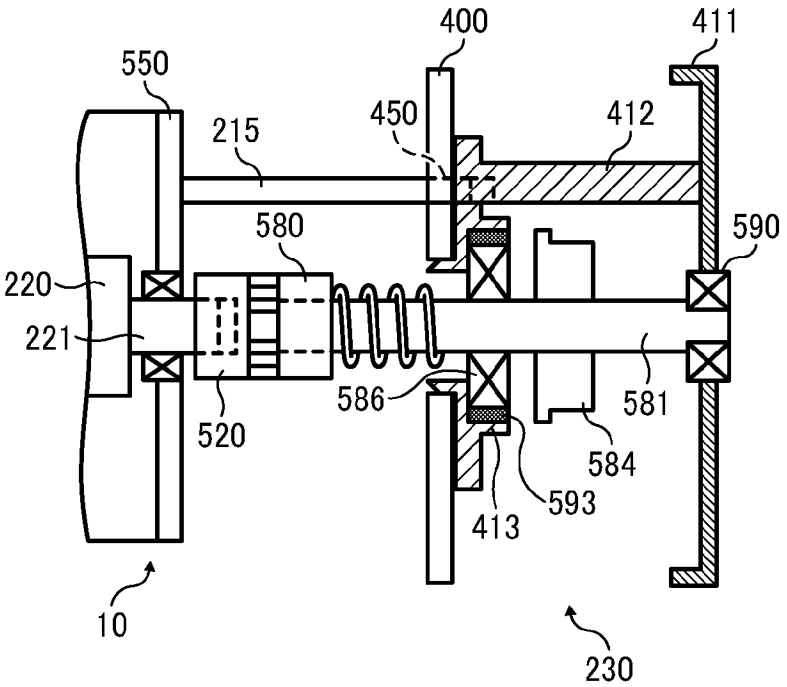
FIG. 7B is an enlarged schematic view illustrating an example of a configuration around the second coupling after coupling to the first coupling.

When the process cartridge 10 is installed in the image forming apparatus 100, a photoconductor drive shaft is inserted into the photoconductor 110 provided in the process cartridge 10. At this time, the sub-reference pin 215 provided to the process cartridge 10 is inserted into a sub-reference hole 450 formed in the lateral plate 400 as illustrated in FIGS. 7A and 7B.

In other words, the process cartridge 10 is installed in the image forming apparatus 100 using the photoconductor drive shaft as a main reference and the sub-reference pin 215 as a sub-reference.

Figure 7A:
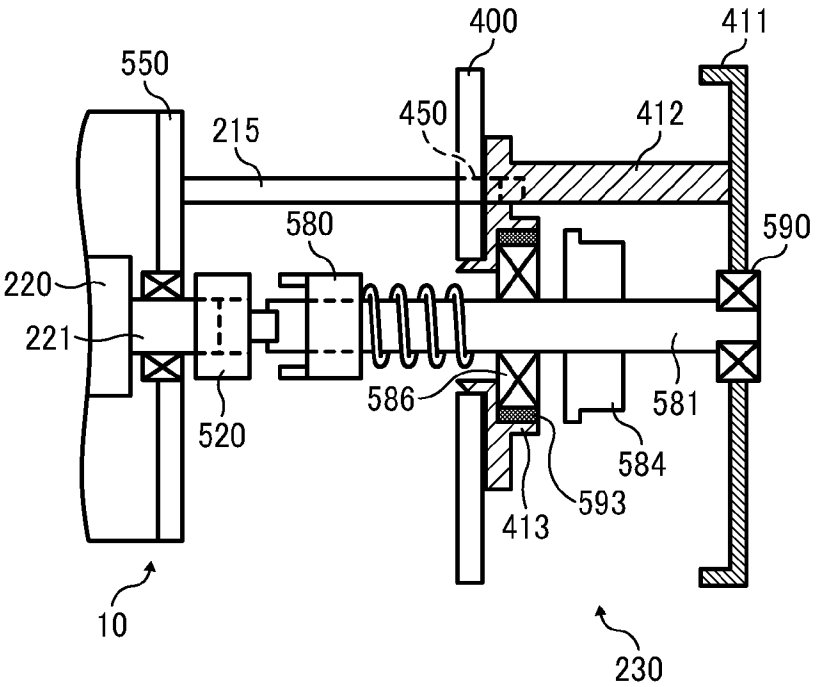
FIG. 7A is an enlarged schematic view illustrating an example of a configuration around a second coupling before coupling to a first coupling.

FIG. 7A is an enlarged schematic view illustrating an example of a configuration around the second coupling 580 before coupling to the first coupling 520. FIG. 7B is an enlarged schematic view illustrating an example of a configuration around the second coupling 580 after coupling to the first coupling 520. The driveshaft 581 of the drive unit 230 and the driven shaft 221 of the developing roller 220 provided to the process cartridge 10 are joined together by coupling the first and second couplings 520 and 580.

The drive shaft 581 is supported by the bracket bearing 586, of which movement in the radial direction is not restricted. Therefore, a slight amount of displacement between the drive shaft 581 and the driven shaft 221 does not adversely affect coupling of the first and second couplings 520 and 580. In addition, the drive shaft 581 and the driven shaft 221 are integrally supported in the radial direction after coupling of the first and second couplings 520 and 580.

Further, a constant-velocity joint is used for both the first and second couplings 520 and 580. Accordingly, uneven transmission of the drive force is further reduced even when there is a displacement between the drive shaft 581 and the driven shaft 221.

Figure 8A:
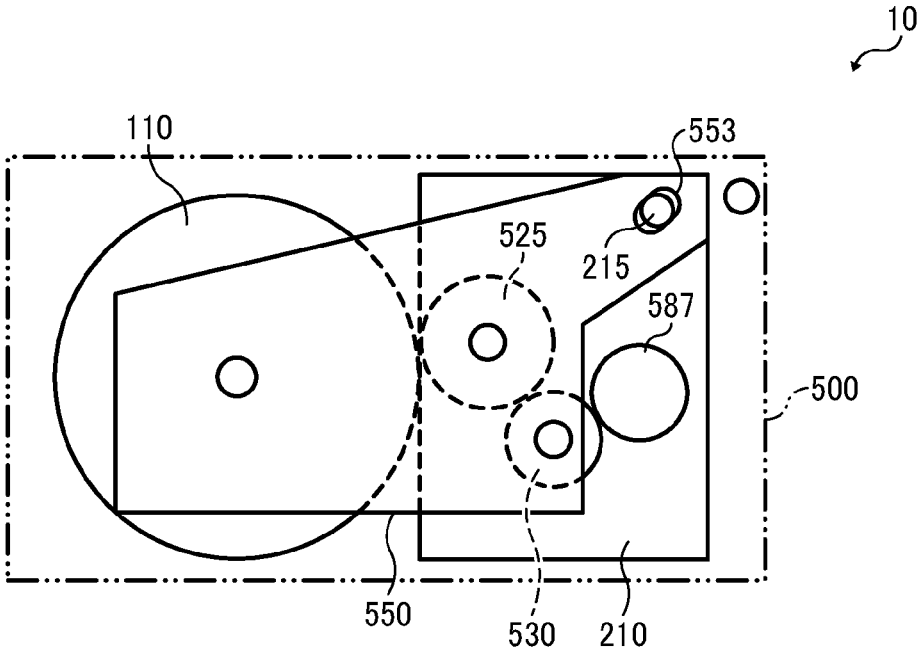
FIG. 8A is a side view illustrating an example of a configuration of a process cartridge detachably installable in an image forming apparatus according to a second illustrative embodiment.
Figure 8B:
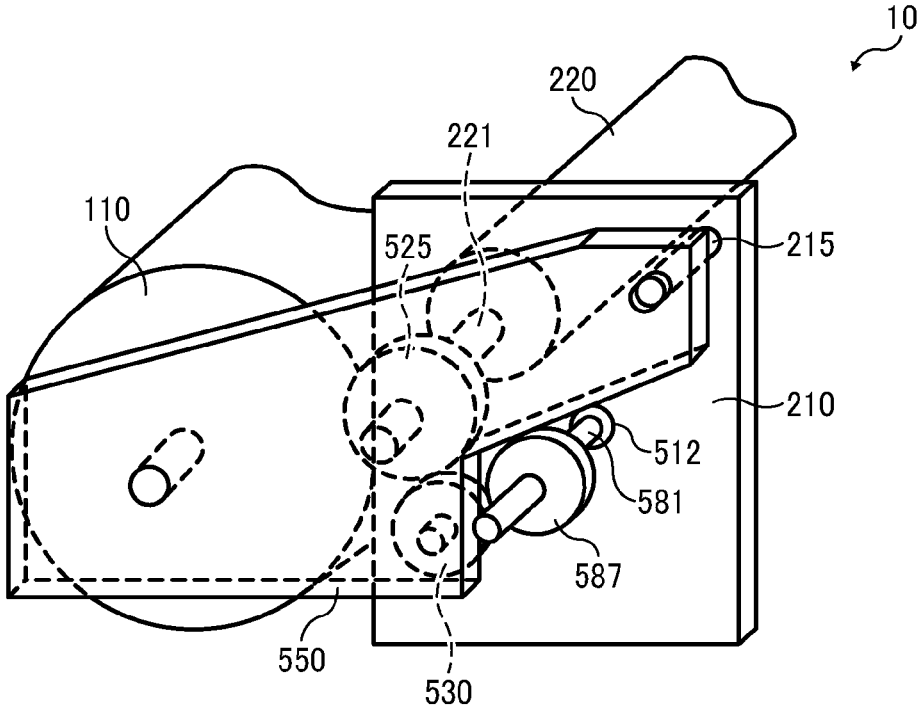
FIG. 8B is a perspective view illustrating the configuration of the process cartridge illustrated in FIG. 8A.

A description is now given of a second illustrative embodiment in which the driven shaft 221 of the developing roller 220 provided to the process cartridge 10 and the drive shaft 581 of the drive unit 230 provided to the main body of the image forming apparatus 100 are joined together by engagement of gears, with reference to FIGS. 8A and 8B. FIG. 8A is a side view illustrating an example of a configuration of the process cartridge 10 detachably attachable to the image forming apparatus 100 according to the second illustrative embodiment, and FIG. 8B is a perspective view illustrating the configuration of the process cartridge 10 illustrated in FIG. 8A. The driven shaft 221 provided to the process cartridge 10 is inserted into a developing gear 525 that engages a cartridge gear 530 having a rotary shaft on the face plate 550.

In place of the second coupling 580 according to the first illustrative embodiment, a drive gear 587 is attached at an end of the drive shaft 581 in the second illustrative embodiment. When the process cartridge 10 is installed in the image forming apparatus 100, the drive shaft 581 is inserted into a bearing hole 512 and the drive gear 587 engages the cartridge gear 530 to transmit the drive force.

In the second illustrative embodiment, the bracket bearing 586 does not restrict movement of the drive shaft 581 in the radial direction.

Figure 9:
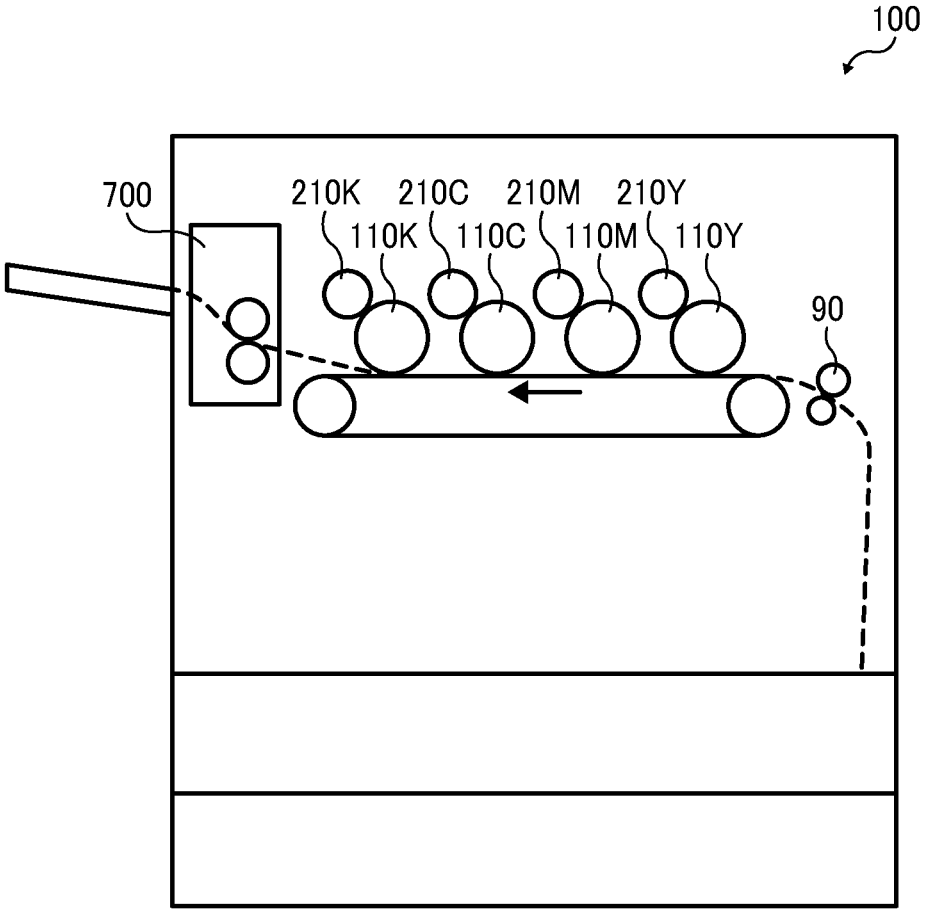
FIG. 9 is a schematic view illustrating another example of a configuration of an image forming apparatus according to illustrative embodiments.

FIG. 9 is a schematic view illustrating another example of a configuration of the image forming apparatus 100. The foregoing illustrative embodiments are applicable to the configuration illustrated in FIG. 9 in which toner images are directly transferred from the surfaces of the photoconductors 110 onto the sheet 99.

The foregoing illustrative embodiments can reliably and easily support the developing devices 210 provided to the process cartridges 10 in the radial direction, and are applicable to image forming apparatuses using the process cartridges.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

a process cartridge detachably installable in the image forming apparatus, the process cartridge comprising a developing device; and a drive unit provided opposite the process cartridge with a lateral plate of the image forming apparatus interposed therebetween to rotatively drive the developing device, the drive unit comprising:

a drive force generator to generate a drive force to rotatively drive the developing device;

a drive substrate to support the drive force generator;

a drive shaft to transmit the drive force generated by the drive force generator to the developing device;

a bracket provided between the lateral plate and the drive unit, the bracket comprising:

a cylindrical bearing seating having a center through which the drive shaft passes;

a bracket bearing provided inside the bearing seating to support the drive shaft in a thrust direction; and an elastic member provided between the bearing seating and the bracket bearing to allow movement of the drive shaft in a radial direction; and a substrate bearing provided to the drive substrate to support the drive shaft in both the radial and thrust directions, wherein the bracket further comprises a positioning rib on a surface thereof attached to the lateral plate to be fitted into an attachment hole in the lateral plate, wherein an outer diameter of the positioning rib and a diameter of the attachment hole in the lateral plate are both smaller than an outer diameter of the bracket bearing.

2. The image forming apparatus according to claim 1, wherein a leading edge of the positioning rib has a tapered shape.

3. The image forming apparatus according to claim 1, wherein the positioning rib has an outer diameter smaller than an outer diameter of the bracket bearing.

4. The image forming apparatus according to claim 1, further comprising coupling members to couple the drive shaft and a driven shaft of the developing device.

5. The image forming apparatus according to claim 4, wherein the coupling members are constant-velocity joints.

6. The image forming apparatus according to claim 1, wherein the drive unit further comprises a timing belt to transmit the drive force generated by the drive force generator to the drive shaft.

7. The image forming apparatus according to claim 1, wherein the bracket is formed of resin.

* * * * *